US008646365B2

(12) United States Patent
Hsieh

(10) Patent No.: US 8,646,365 B2
(45) Date of Patent: Feb. 11, 2014

(54) HAND TOOL WITH ADJUSTABLE SWING ANGLE

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 265 days.

(21) Appl. No.: 13/349,524

(22) Filed: Jan. 12, 2012

(65) Prior Publication Data

US 2013/0019719 A1 Jan. 24, 2013

(30) Foreign Application Priority Data

Jul. 21, 2011 (TW) ..... 100125840 A

(51) Int. Cl.
*B25G 1/06* (2006.01)
*B25G 3/38* (2006.01)

(52) U.S. Cl.
USPC ..... 81/177.8; 403/97

(58) Field of Classification Search
USPC ..... 81/177.7, 177.8, 177.9; 403/91–94, 403/97–100, 298
See application file for complete search history.

(56) References Cited

U.S. PATENT DOCUMENTS

| | | | | | |
|---|---|---|---|---|---|
| 5,419,221 | A * | 5/1995 | Cole | 81/60 |
| 6,000,299 | A * | 12/1999 | Cole | 81/60 |
| 6,101,907 | A * | 8/2000 | McGovern et al. | 81/177.8 |
| 6,161,982 | A * | 12/2000 | Cole | 403/97 |
| 6,216,565 | B1 * | 4/2001 | McCann | 81/177.8 |
| 7,415,911 | B2 | 8/2008 | Cole et al. | |
| 7,987,749 | B2 | 8/2011 | Hsieh | |

FOREIGN PATENT DOCUMENTS

| | | | |
|---|---|---|---|
| EP | 0768937 | A1 | 12/1995 |
| EP | 1004403 | A2 | 5/2000 |
| WO | WO 2008/144235 | A1 | 11/2008 |

* cited by examiner

*Primary Examiner* — David B Thomas
(74) *Attorney, Agent, or Firm* — Guice Patents PLLC

(57) ABSTRACT

A hand tool with adjustable swing angle includes a first and a second ends connected with each other to contain an adjustable angle. The first end has an upper wall section having a first splined hole and a lower wall section having a through hole. An annular groove is formed on a circumferential wall of the through hole. The second end is formed with a second splined hole positioned between the first splined hole and the through hole. An engagement member having a bulged section is positioned in the splined holes. An elastic restriction ring is positioned in the annular groove and has at least two holding sections positioned in the through hole. When moving the engagement member up and down, the elastic restriction ring is expanded by the bulged section, permitting the engagement member to engage with both the first and second ends or only the second end.

18 Claims, 8 Drawing Sheets

HAND TOOL WITH ADJUSTABLE SWING ANGLE

BACKGROUND OF THE INVENTION

1. Field of the Invention

The present invention relates generally to a hand tool, and more particularly to a hand tool with adjustable swing angle.

2. Description of the Related Art

The applicant's U.S. Pat. No. 7,987,749 discloses a wrench with a rotatable head as shown in FIGS. 1 and 2. The wrench with the rotatable head includes a handle 10 and at least one head section 11 pivotally connected with the handle 10 via an engagement pin 14. Accordingly, the relative angle contained between the handle 10 and the head section 11 is adjustable. One end of the handle 10 has an upper wall section 12 and a lower wall section 13 spaced from each other by a certain distance. The upper wall section 12 is formed with a first splined hole 121 and the lower wall section 13 is formed with a through hole 131. A restriction flange 132 is formed on a wall face of the through hole 131. The head section 11 extends into a space between the upper and lower wall sections 12, 13. The head section 11 has a second splined hole 111 positioned between the first splined hole 121 and the through hole 131. The engagement pin 14 is up and down movably mounted in the first and second splined holes 121, 111.

An annular groove 141 is formed on a circumference of the engagement pin 14. A C-shaped retainer 142 is disposed in the annular groove 141. The C-shaped retainer 142 has an outer diameter larger than an inner diameter of the second splined hole 111 of the head section 11. Several springs 143 and steel balls 144 are embedded in a bottom end of the engagement pin 14. When the engagement pin is positioned in an engagement position as shown in FIG. 2, the engagement pin 14 is engaged with both the first and second splined holes 121, 111. In this case, the angle contained between the handle 10 and the head section 11 is fixed. Under such circumstance, the C-shaped retainer 142 abuts against a bottom face of the second splined hole 111 to prevent the engagement pin 14 from upward detaching out of the first and second splined holes 121, 111. The steel balls 144 abut against a top face of the restriction flange 132 to keep the engagement pin 14 in the engagement position. When adjusting the relative angle contained between the handle 10 and the head section 11, the engagement pin 14 is moved downward to a release position (not shown), whereby the engagement pin 14 is disengaged from the first splined hole 121, permitting the handle 10 and the head section 11 to rotate relative to each other. At this time, the steel balls 144 pass over the restriction flange 132 to be positioned under the restriction flange 132, whereby the engagement pin 14 is kept in the release position. The C-shaped retainer 142 abuts against the restriction flange 132 to avoid detachment of the engagement pin 14.

The above mechanism for locating the engagement pin 14 and avoiding detachment of the engagement pin 14 is complicated and includes numerous components and is thus hard to manufacture. For example, it is necessary to drill holes on the engagement pin 14 for manually installing the springs 143 and the steel balls 144 into the holes. In addition, it is necessary to form the annular groove 141 on the engagement pin 14 for receiving the C-shaped retainer 142.

SUMMARY OF THE INVENTION

It is therefore a primary object of the present invention to provide a hand tool with adjustable swing angle, which has a simple structure and is easy to assemble so that the manufacturing cost is lowered.

It is a further object of the present invention to provide the above hand tool with adjustable swing angle, in which the engagement structure is easy to locate and prevented from detaching from the hand tool.

It is still a further object of the present invention to provide the above hand tool with adjustable swing angle, which can be more accurately and conveniently operated to avoid misoperation.

To achieve the above and other objects, the hand tool with adjustable swing angle of the present invention includes:

a first end and a second end connected with each other, the first and second ends containing a relative angle, which is adjustable;

an upper wall section and a lower wall section disposed at the first end in parallel to each other, a first splined hole being disposed on the upper wall section and formed with multiple splines on a circumferential wall thereof, a through hole being disposed on the lower wall section in alignment with the first splined hole, an annular groove being formed on a circumferential wall of the through hole in communication with the through hole;

a second splined hole being disposed on the second end and formed with multiple splines on a circumferential wall thereof, the second end extending into a space between the upper and lower wall sections, and the second splined hole being positioned between the first splined hole and the through hole;

an engagement member being positioned in the two splined holes and movable between an engagement position and a release position within the two splined holes, the engagement member having an engagement section and a bulged section positioned under the engagement section; and an elastic restriction ring including at least two holding sections in parallel to each other and a surrounding section connected between the holding sections and kept in the annular groove of the lower wall section; wherein the holding sections are spaced from each other by a distance smaller than the diameter of the bulged section; the holding sections are positioned in the through hole.

When the engagement member is moved between the release position and the engagement position, the holding sections of the elastic restriction ring are expanded by the bulged section of the engagement member, permitting the engagement pin to move within the first and second ends.

When the engagement member is upward moved to the engagement position, the engagement section is engaged with both the first and second splined holes to fix the relative angle contained between the first and second ends. Under such circumstance, the holding sections of the elastic restriction ring are positioned on a lower side of the bulged section to keep the engagement pin in the engagement position.

When the engagement member is downward moved to the release position, the engagement section is only engaged with the second splined hole. In this case, the relative angle contained between the first and second ends is adjustable. Under such circumstance, the holding sections of the elastic restriction ring are positioned on an upper side of the bulged section to keep the engagement member in the release position.

The present invention can be best understood through the following description and accompanying drawings, wherein:

DETAILED DESCRIPTION OF THE PREFERRED EMBODIMENTS

Figure 1:
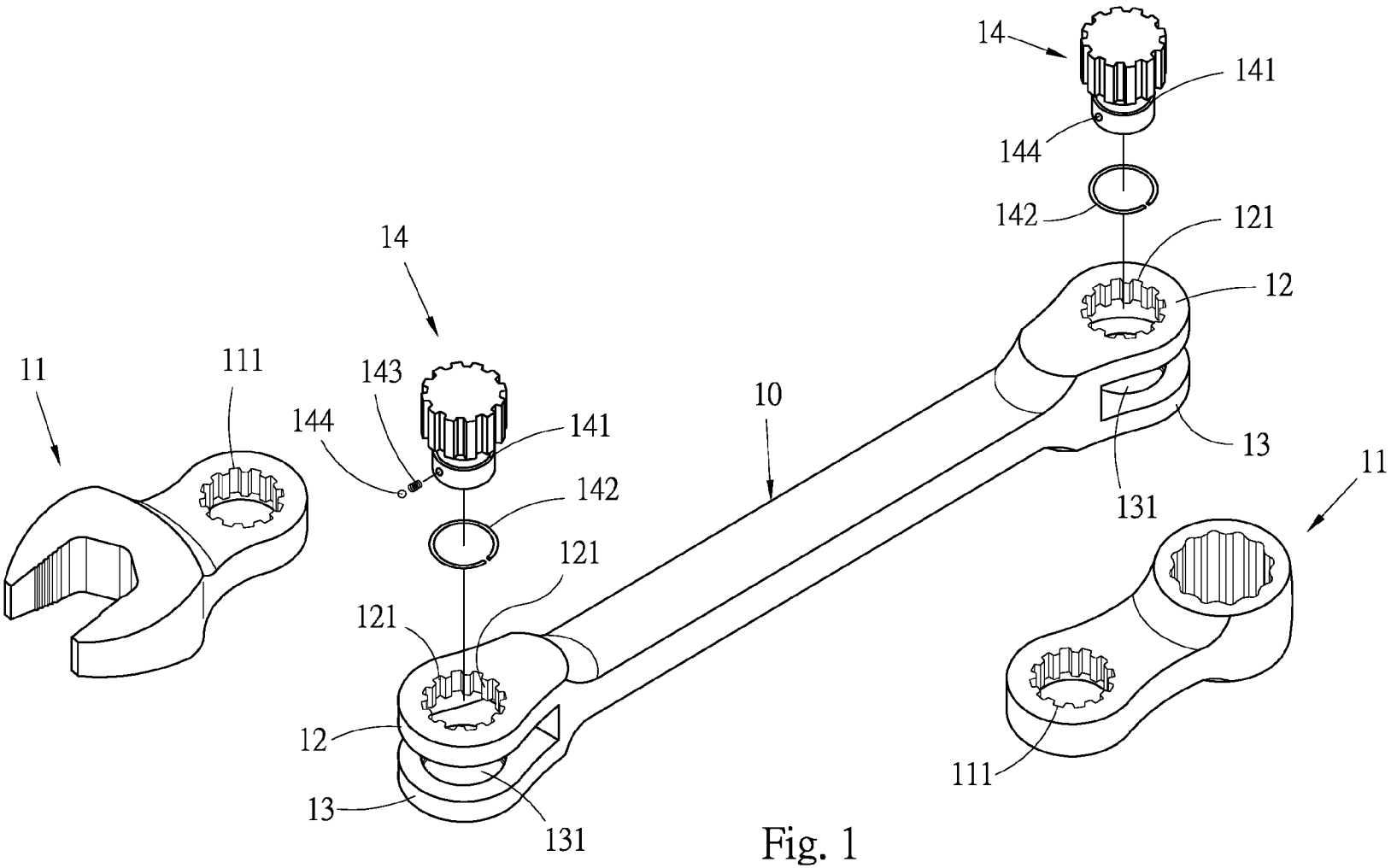
Fig. 1 PRIOR ART
FIG. 1 is a perspective exploded view of a conventional wrench with a rotatable head.
Figure 2:
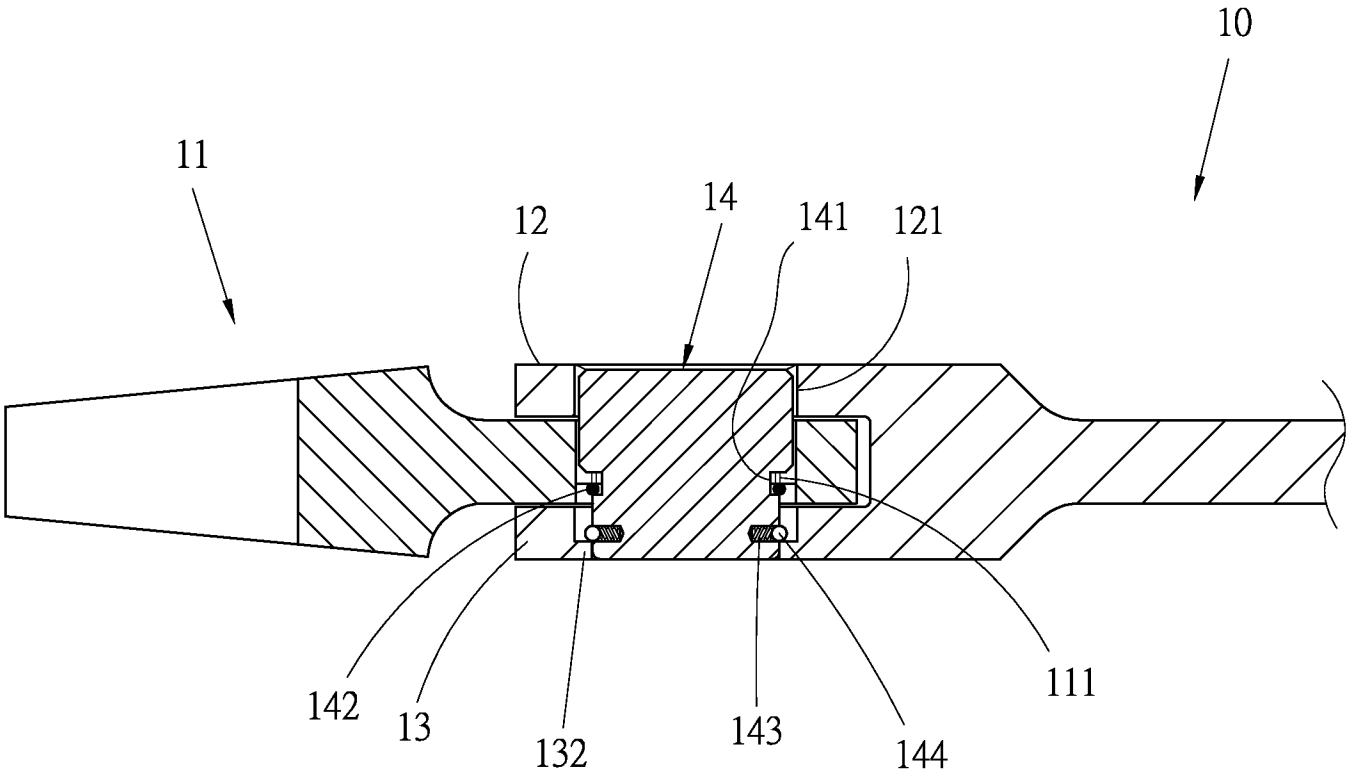
Fig. 2 PRIOR ART
FIG. 2 is a sectional assembled view of a part of the conventional wrench with the rotatable head according to FIG. 1.
Figure 3:
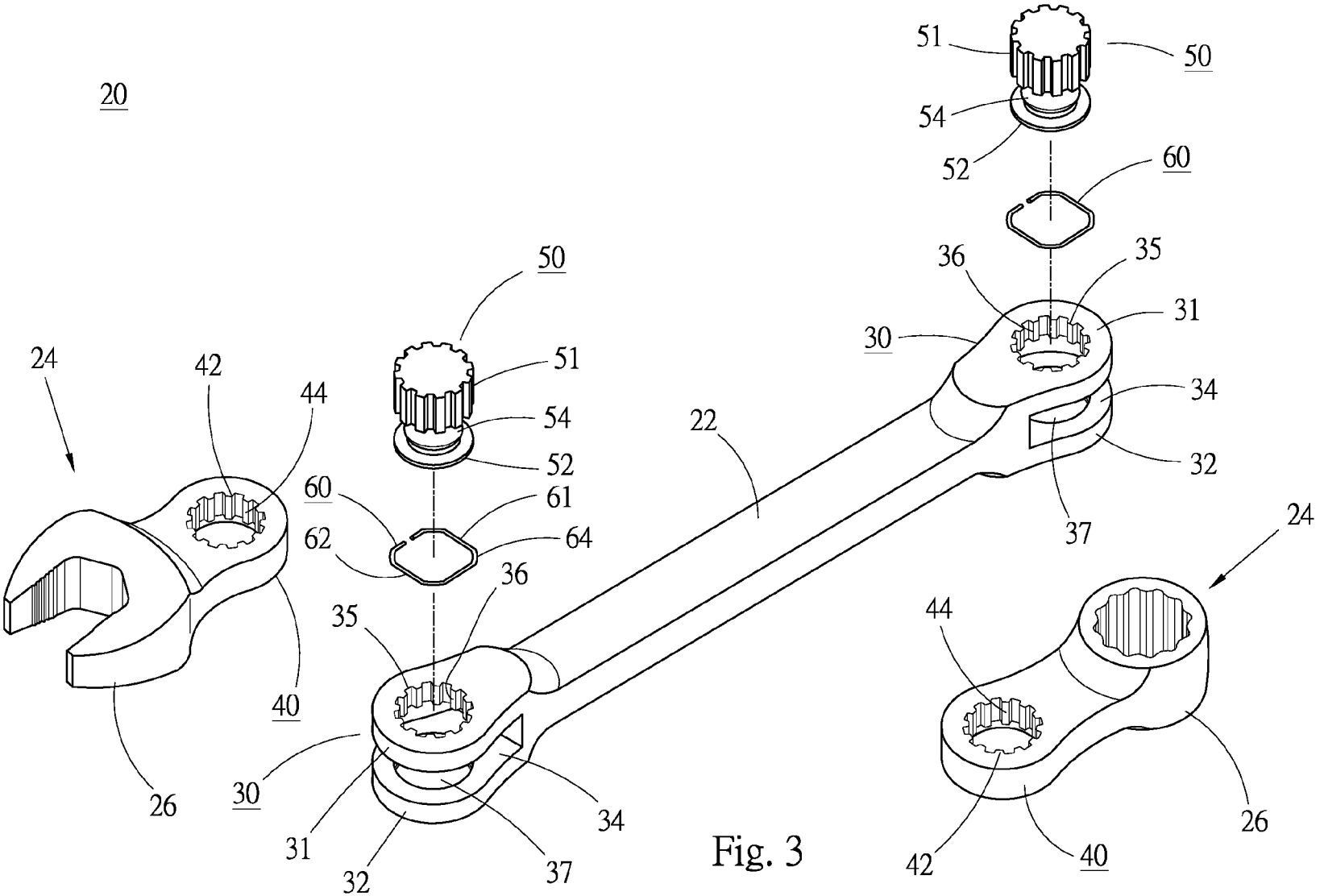
FIG. 3 is a perspective exploded view of a preferred embodiment of the hand tool of the present invention.
Figure 4:
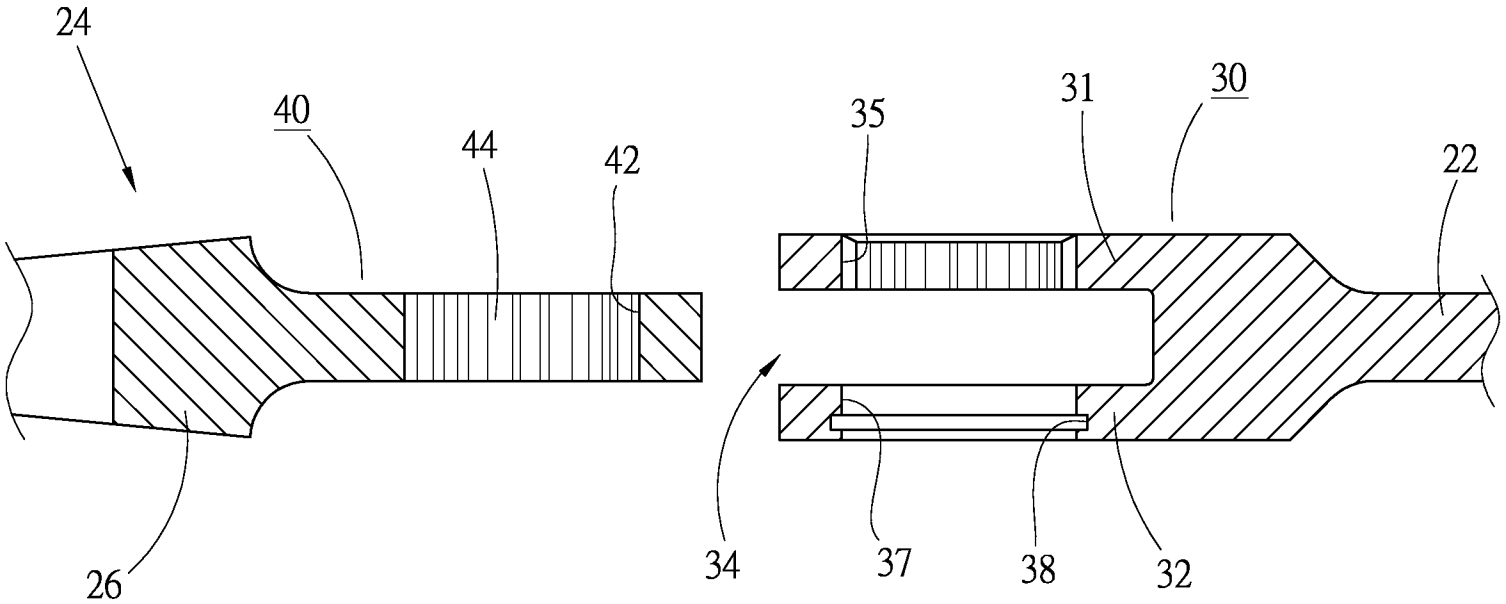
FIG. 4 is a sectional exploded view of the first and second ends of the preferred embodiment of the hand tool of the present invention.

Please refer to FIG. 3. According to a preferred embodiment, a hand tool with adjustable swing angle of the present invention is, but not limited to, a wrench with a rotatable head for illustration purposes only. The wrench 20 includes a handle 22 and at least one head section 24. The handle 22 and the head section 24 are connected with each other via a first end 30 and a second end 40. The second end 40 is such connected with the first end 30 that the relative angle contained between the handle 22 and the head section 24 is adjustable. The first and second ends 30, 40 are switchable. In this embodiment, the first end 30 is disposed on the handle 22, while the second end 40 is disposed on the head section 24. The head section 24 further has a wrenching end 26 opposite to the second end 40. The wrenching end 26 pertains to prior art and thus will not be further described hereinafter. Referring to FIG. 4, the first end 30 has an upper wall section 31 and a lower wall section 32 in parallel to each other. The upper and lower wall sections 31, 32 define therebetween a space 34. The second end 40 can be extended into the space 34 and positioned between the upper and lower wall sections 31, 32.

The wrench 20 has an engagement structure, whereby a user can adjust the relative angle contained between the first end 30 of the handle 22 and the second end 40 of the head section 24 with one single hand. The engagement structure includes: a first splined hole 35 disposed on the upper wall section 31 and formed with multiple splines on a circumferential wall thereof, a through hole 37 disposed on the lower wall section 32 in alignment with the first splined hole 35; and an annular groove 38 formed on a circumferential wall of the through hole 37 in communication with the through hole 37.

The engagement structure further includes a second splined hole 42 disposed on the second end 40 and positioned between the first splined hole 35 and the through hole 37. A circumferential wall of the second splined hole 42 is formed with multiple splines.

The engagement structure further includes an engagement member 50 positioned in the two splined holes 35, 42 and the through hole 37. The engagement member 50 is movable between an upper engagement position (as shown in FIG. 6) and a lower release position (as shown in FIG. 7).

Figure 5:
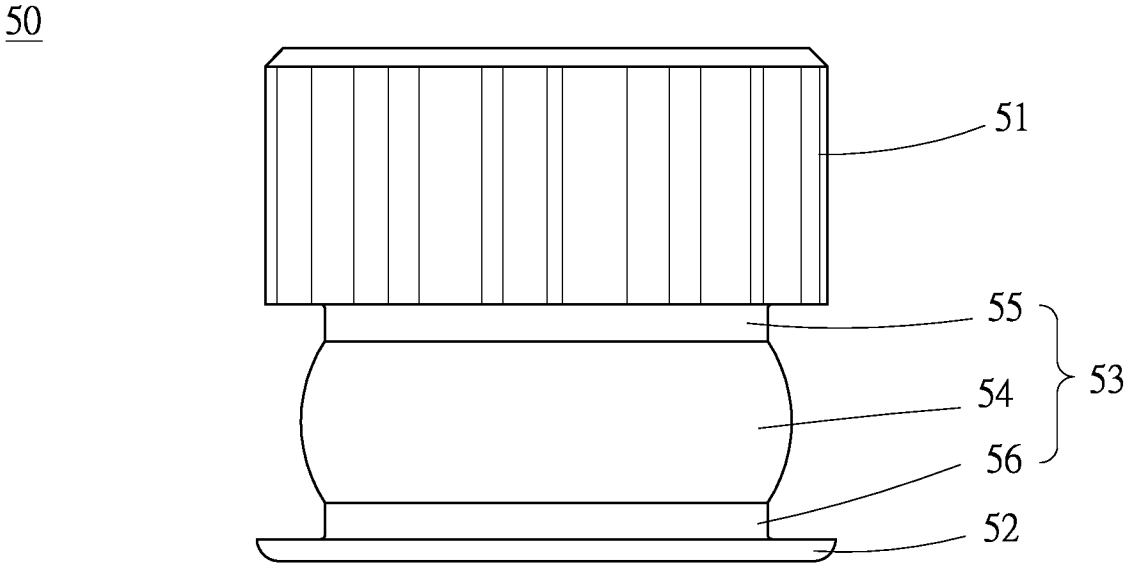
FIG. 5 is a side view of the engagement member of the preferred embodiment of the hand tool of the present invention.

Referring to FIG. 5, the engagement member 50 has an engagement section 51 disposed at a top section thereof and a bottom flange 52 disposed at a bottom thereof. Multiple splines are formed on a circumference of the engagement section 51 for engaging with the two splined holes 35, 42. The engagement member 50 further has a body 53 positioned between the engagement section 51 and the bottom flange 52. The body 53 has a bulged section 54, a first locating section 55 formed on upper side of the bulged section 54 and a second locating section 56 formed on lower side of the bulged section 54. The two locating sections 55, 56 have a diameter smaller than that of the bulged section 54. The bottom flange 52 has a diameter larger than that of the second locating section 56. The bulged section 54 has a surface, which is an arcuate face or an oblique face. The bulged section 54 has a maximum diameter in the middle. The diameter of the bulged section 54 descends from the middle to the upper and lower ends. The bulged section 54 and the two locating sections 55, 56 have a circular cross section.

Figure 6:
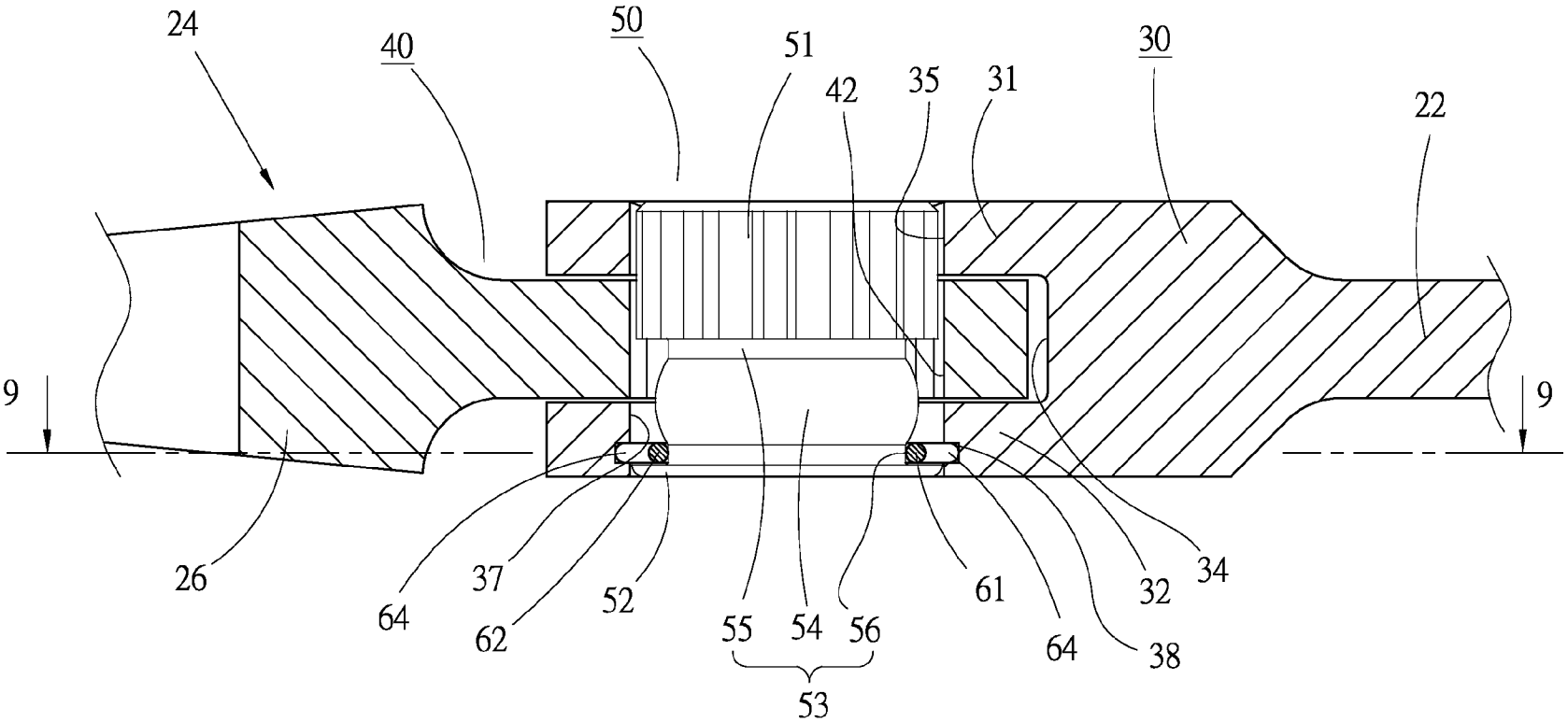
FIG. 6 is a sectional assembled view of the preferred embodiment of the hand tool of the present invention, showing that the engagement member is positioned in the engagement position.
Figure 7:
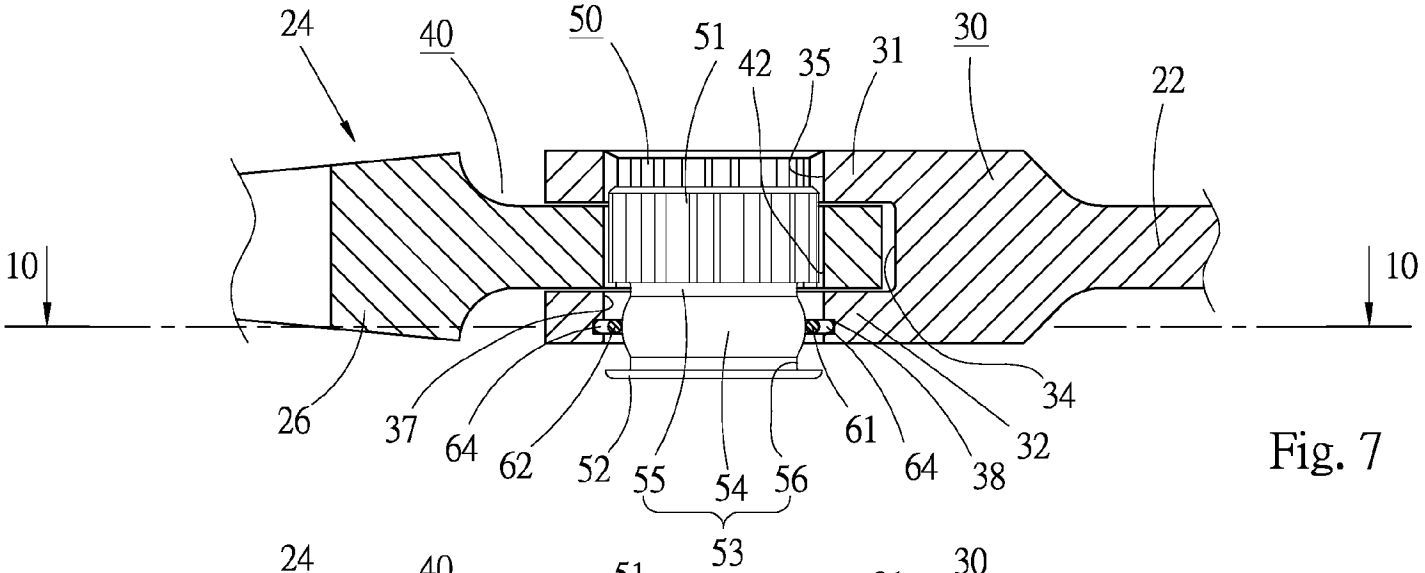
FIG. 7 is a sectional assembled view according to FIG. 6, showing that the engagement member is moved midway between the engagement position and the release position.
Figure 8:
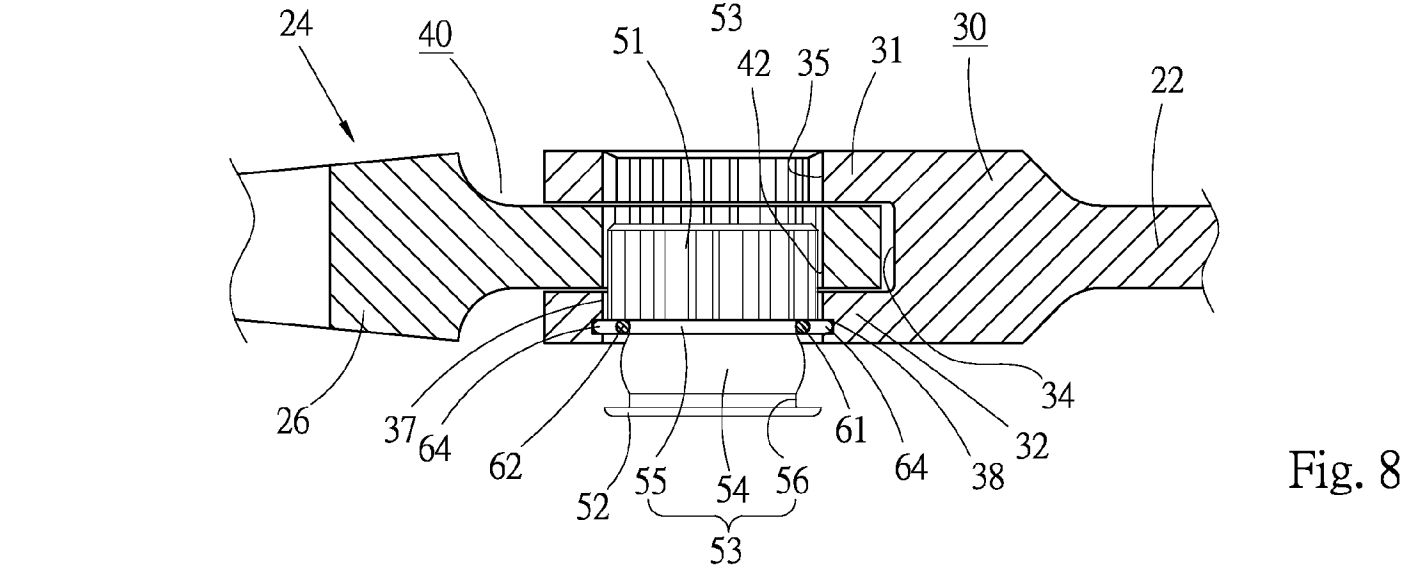
FIG. 8 is a sectional assembled view according to FIG. 6, showing that the engagement member is positioned in the release position.

Referring to FIGS. 6 to 8, the engagement structure further includes an elastic restriction ring 60 disposed in the annular groove 38. The elastic restriction ring 60 includes at least one first and second holding sections 61, 62, which are left and right side by side arranged. The elastic restriction ring 60 further includes a surrounding section connecting the first and second holding sections 61, 62, and the surrounding section is positioned in the annular groove 38 of the lower wall section 32. The surrounding section at least includes two abutment sections 64 respectively connected to one end of the first and second holding sections 61, 62 for the elastic restriction ring 60 staying at the annular groove 38. In this embodiment, the elastic restriction ring 60 substantially has the form of a rectangle and the surrounding section includes totally four abutment sections 64 as four angles of the rectangle. The abutment sections 64 can have an arcuate form for abutting against inner wall face of the annular groove 38. The two holding sections 61, 62 are positioned in the through hole 37 thereby and spaced from each other by a distance smaller than the diameter of the bulged section 54 of the engagement member 50. The holding sections 61, 62 of the elastic restriction ring 60 are capable of elastically outward expanding or restoring. When the engagement member 50 is moved between the release position and the engagement position, the holding sections 61, 62 of the elastic restriction ring 60 are elastically outward expanded to partially enter the annular groove 38, whereby the engagement member 50 can be moved within the first and second ends 30, 40.

In the present invention, the engagement structure of the hand tool operates in a manner as follows:

Please refer to FIG. 6. When the engagement member 50 is upward moved to the engagement position, the engagement section 51 of the engagement member 50 is moved into the first and second splined holes 35, 42 to engage with both the first and second splined holes 35, 42. In this case, the first and second ends 30, 40 are fixed with each other and cannot be rotated relative to each other, whereby a user can hold the handle 22 to wrench a nut with the head section 24. Under such circumstance, the two holding sections 61, 62 of the elastic restriction ring 60 are positioned at the second locating section 56 of the engagement member 50, and preferably, elastically hold the second locating section 56. The holding sections 61, 62 abut against the bottom edge of the bulged section 54 to keep the engagement member in the engagement position. Also, the elastic restriction ring 60 abuts against the bottom flange 52 of the engagement member 50 to avoid upward detachment of the engagement member 50.

Please now refer to FIG. 8. When the engagement member 50 is downward moved to the release position, the engagement section 51 of the engagement member 50 is only engaged with the second splined hole 42. In this case, the first and second ends 30, 40 can be freely rotated relative to each other. Under such circumstance, the holding sections 61, 62 of the elastic restriction ring 60 are positioned at the first locating section 55 to elastically hold the first locating section 55. The holding sections 61, 62 abut against the top edge of the bulged section 54 to keep the engagement member in the release position. Also, the elastic restriction ring 60 abuts against the bottom end of the engagement section 51 to avoid downward detachment of the engagement member 50.

Figure 10:
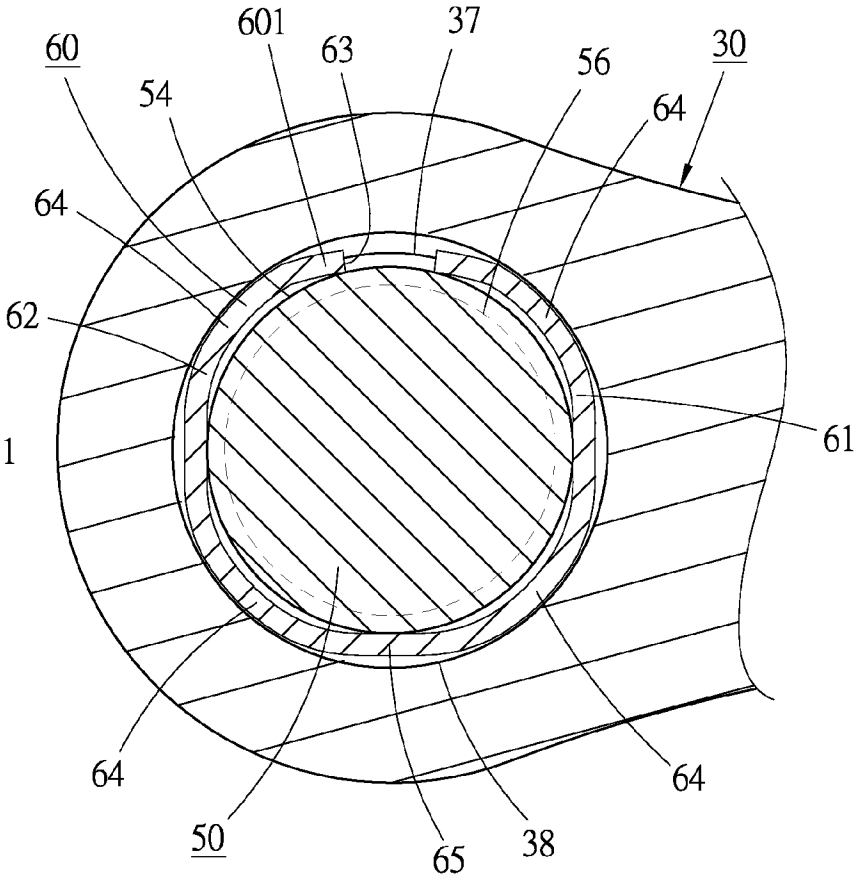
FIG. 10 is a sectional view taken along line 10-10 of FIG. 7.
Figure 9:
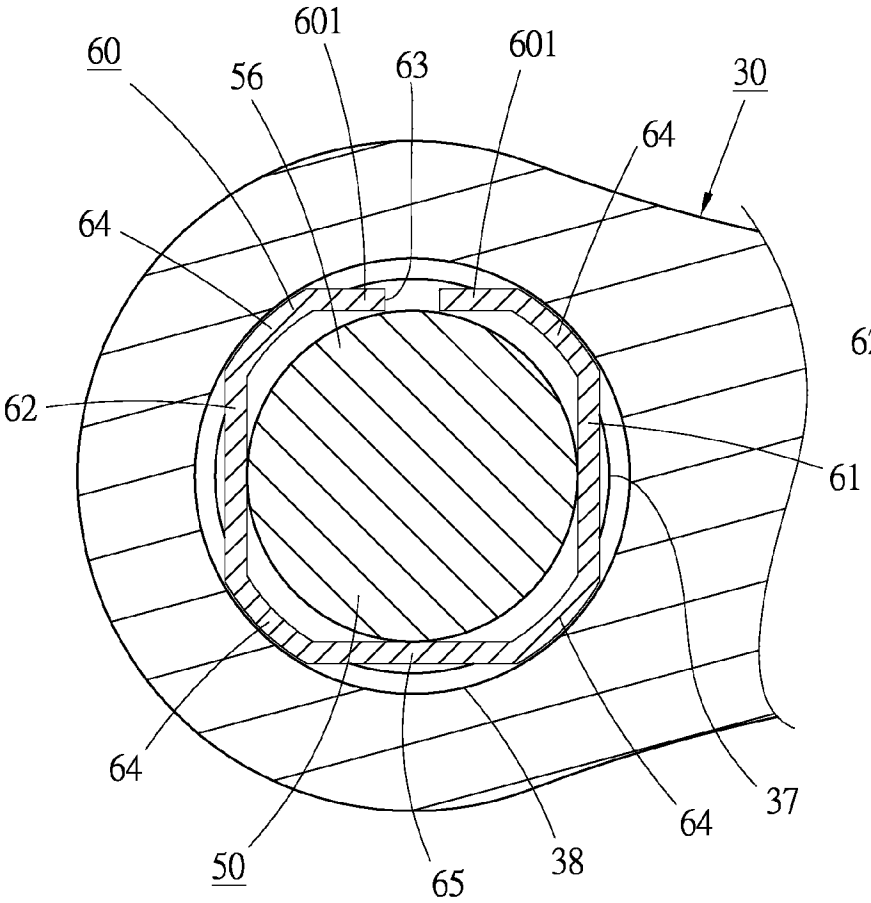
FIG. 9 is a sectional view taken along line 9-9 of FIG. 6.

Referring to FIGS. 7, 9 and 10, when the engagement member 50 is moved between the release position and the engagement position, the bulged section 54 of the engagement member 50 can elastically expand the holding sections 61, 62 of the elastic restriction ring 60, whereby the engagement member 50 can be moved within the first and second ends 30, 40. When the engagement member 50 is positioned in the release position, the relative angle contained between the first and second ends 30, 40 is adjustable. When the engagement member 50 is positioned in the engagement position, the relative angle contained between the first and second ends 30, 40 is fixed.

It should be noted that no matter whether the two holding sections 61, 62 are positioned at the first locating section 55 or the second locating section 56, both the holding sections 61, 62 can abut against the top end or bottom end of the bulged section 54 and avoid detachment of the engagement member 50. In practice, it is unnecessary for the two holding sections 61, 62 to hold the first locating section 55 or the second locating section 56.

A user can press the engagement member with one single hand to fix the first and second ends with each other or free the first and second ends from each other for adjusting the angle. Moreover, it is unnecessary to form any hole on the engagement member for receiving the springs and steel balls or form any annular groove on the engagement member for receiving the C-shaped retainer. Therefore, the number of the components is reduced and the manufacturing process is simplified to lower the cost.

In addition, the elastic restriction ring of the present invention provides at least two holding sections in the through holes. The holding sections can be elastically deformed and expanded or restored. When the two holding sections 61, 62 are positioned in either locating section, the engagement member is located and prevented from detaching.

Please now refer to FIG. 9. In this embodiment, the elastic restriction ring 60 has two ends defining a split 63 therebetween. The elastic restriction ring 60 further has a third holding section 65. Two ends of the third holding section 65 connect two abutment sections 64 respectively. The third holding section 65 is substantially normal to the two holding sections 61, 62, and opposite to the split 63. The elastic restriction ring 60 has totally four abutment sections 64. The two ends of the elastic restriction ring 60 form two small holding sections 601 on two sides of the split 63. The two small holding sections 601 are connected with two abutment sections 64 respectively. With the third holding section 65 and the two small holding sections 601, the engagement member 50 can be more securely held in its true position. The elastic restriction ring 60 can be in any form. For example, the elastic restriction ring 60 can be U-shaped and have two parallel holding sections and an arcuate abutment section connected between the holding sections. No matter what form the elastic restriction ring 60 has, the abutment section serves as a surrounding section of the elastic restriction ring.

During elastic deformation of the holding sections 61, 62, 65, the surrounding sections of the elastic restriction ring 60 are always positioned in the annular groove 38 to avoid detachment of the elastic restriction ring 60 out of the annular groove 38.

In this embodiment, the diameter of the bulged section 54 of the engagement member 50 is slightly smaller than the diameter of the engagement section 51. Accordingly, during the up and down movement of the engagement member 50, the two holding sections 61, 62 of the elastic restriction ring 60 are not entirely retreated into the annular groove 38.

The present invention has a simple structure and is easy to assemble so that the manufacturing cost is lowered. When pressing the engagement pin, a user can judge whether the engagement member has reached the engagement position or the release position by means of checking whether the holding sections of the elastic restriction ring have elastically restored to their original positions. Accordingly, the operation can be more accurately and conveniently performed to avoid mis-operation.

The above embodiments are only used to illustrate the present invention, not intended to limit the scope thereof. Many modifications of the above embodiments can be made without departing from the spirit of the present invention.

What is claimed is:

1. A hand tool with adjustable swing angle, comprising:

a first end and a second end connected with each other, the first and second ends containing a relative angle, which is adjustable;

an upper wall section and a lower wall section disposed at the first end in parallel to each other, the upper and lower wall sections defining therebetween a space, a first splined hole being disposed on the upper wall section and formed with multiple splines on a circumferential wall thereof, a through hole being disposed on the lower wall section in alignment with the first splined hole, an annular groove being formed on a circumferential wall of the through hole;

a second splined hole being disposed on the second end and formed with multiple splines on a circumferential wall thereof, the second end extending into the space of the first end and being positioned between the upper and lower wall sections, the second splined hole being positioned between the first splined hole and the through hole;

an engagement member positioned in the two splined holes and movable between an engagement position and a release position within the two splined holes, the engagement member having an engagement section disposed at a top section thereof, multiple splines being formed on a circumference of the engagement section, the engagement member further having a body positioned under the engagement section, the body having a bulged section, a first locating section formed on an upper side of the bulged section and a second locating section formed on a lower side of the bulged section, the two locating sections having a diameter smaller than that of the bulged section; and an elastic restriction ring including at least two holding sections in parallel to each other and a surrounding section connecting the holding sections, the holding sections being spaced from each other by a distance smaller than the diameter of the bulged section, whereby the holding sections are capable of elastically outward expanding or restoring, the surrounding section of the elastic restriction ring being positioned in the annular groove of the lower wall section, the holding sections being positioned in the through hole, when the engagement member is moved between the release position and the engagement position, the holding sections of the elastic restriction ring being expanded by the bulged section, permitting the engagement member to move within the first and second ends, when the engagement member is upward moved to the engagement position, the engagement section being engaged with both the first and second splined holes and the holding sections of the elastic restriction ring being positioned at the second locating section, when the engagement member is downward moved to the release position, the engagement section being only engaged with the second splined hole and the holding sections of the elastic restriction ring being positioned at the first locating section, whereby when the engagement member is positioned in the release position, the relative angle contained between the first and second ends is adjustable, while when the engagement member is positioned in the engagement position, the relative angle contained between the first and second ends is fixed.

2. The hand tool as claimed in claim 1, wherein the surrounding section of the elastic restriction ring has at least one abutment section connecting the holding sections.

3. The hand tool as claimed in claim 2, wherein the elastic restriction ring has two ends defining a split therebetween.

4. The hand tool as claimed in claim 3, wherein the surrounding section of the elastic restriction ring has at least two abutment sections respectively connecting with one end of one holding section and one end of the other holding section, the elastic restriction ring further having a third holding section substantially normal to the two holding sections opposite to the split, two ends of the third holding section being respectively connected with the two abutment sections.

5. The hand tool as claimed in claim 4, wherein the surrounding section of the elastic restriction ring has four abutment sections substantially as four angles of the elastic restriction ring, the four abutment sections being connected with the holding sections.

6. The hand tool as claimed in claim 4, wherein the engagement member further has a bottom flange disposed at a bottom thereof, the bottom flange having a diameter larger than that of the second locating section of the body.

7. The hand tool as claimed in claim 2, wherein the surrounding section of the elastic restriction ring has at least two abutment sections respectively connecting with one end of one holding section and one end of the other holding section, the elastic restriction ring further having a third holding section substantially normal to the two holding sections, two ends of the third holding section being respectively connecting the two abutment sections.

8. The hand tool as claimed in claim 7, wherein the engagement member further has a bottom flange disposed at a bottom thereof, the bottom flange having a diameter larger than that of the second locating section of the body.

9. The hand tool as claimed in claim 2, wherein the engagement member further has a bottom flange disposed at a bottom thereof, the bottom flange having a diameter larger than that of the second locating section of the body.

10. The hand tool as claimed in claim 1, wherein the elastic restriction ring has two ends defining a split therebetween.

11. The hand tool as claimed in claim 10, wherein the engagement member further has a bottom flange disposed at a bottom thereof, the bottom flange having a diameter larger than that of the second locating section of the body.

12. The hand tool as claimed in claim 1, wherein the engagement member further has a bottom flange disposed at a bottom thereof, the bottom flange having a diameter larger than that of the second locating section of the body.

13. The hand tool as claimed in claim 1, wherein the bulged section has a maximum diameter in the middle, the diameter of the bulged section descending from the middle to the upper and lower ends of the bulged section.

14. The hand tool as claimed in claim 1, wherein when the engagement member is positioned in the engagement position, the holding sections elastically hold or do not hold the second locating section; when the engagement member is positioned in the release position, the holding sections elastically hold or do not hold the first locating section.

15. The hand tool as claimed in claim 1, wherein the bulged section and the two locating sections of the engagement member have a circular cross section.

16. A hand tool with adjustable swing angle, comprising:

a first end and a second end;

an upper wall section and a lower wall section disposed at the first end in parallel to each other, the upper and lower wall sections defining therebetween a space, a first splined hole being disposed on the upper wall section and formed with multiple splines on a circumferential wall thereof, a through hole being disposed on the lower wall section in alignment with the first splined hole, an annular groove being formed on a circumferential wall of the through hole;

a second splined hole being disposed on the second end and formed with multiple splines on a circumferential wall thereof, the second end extending into the space of the first end and being positioned between the upper and lower wall sections, the second splined hole being positioned between the first splined hole and the through hole;

an engagement member being positioned in the two splined holes and movable between an engagement position and a release position, the engagement member having an engagement section disposed at a top section thereof, and multiple splines being formed on a circumference of the engagement section, the engagement member further having a body positioned under the engagement section, the body having a bulged section, the bulged section having a maximum diameter in the middle, the diameter of the bulged section descending from the middle to the upper and lower ends of the bulged section; and an elastic restriction ring including at least two holding sections in parallel to each other and a surrounding section connecting the holding sections, the holding sections being spaced from each other by a distance smaller than the diameter of the bulged section, whereby the holding sections is capable of elastically outward expanding or restoring, the surrounding section of the elastic restriction ring being positioned in the annular groove of the lower wall section, the holding sections being positioned in the through hole, when the engagement member is moved between the release position and the engagement position, the holding sections of the elastic restriction ring being expanded by the bulged section, permitting the engagement member to move within the first and second ends, when the engagement member is upward moved to the engagement position, the engagement section being engaged with both the first and second splined holes and the holding sections of the elastic restriction ring being positioned at a bottom edge of the bulged section, when the engagement member is downward moved to the release position, the engagement section being only engaged with the second splined hole and the holding sections of the elastic restriction ring being positioned at a top edge of the bulged section.

17. The hand tool as claimed in claim 16, wherein the engagement member further has a bottom flange disposed at a bottom thereof, the bottom flange having a diameter larger than that of bottom end of the bulged section.

18. The hand tool as claimed in claim 16, wherein the hand tool includes a handle and a head section; the first end and the second end are disposed on the handle and the head section respectively.

* * * * *